US007060003B1

(12) United States Patent
Reynolds et al.

(10) Patent No.: US 7,060,003 B1
(45) Date of Patent: Jun. 13, 2006

(54) HORIZONTAL ROPE PULLING APPARATUS

(76) Inventors: Lynn Reynolds, 300 Kalli Cir., Wasilla, AK (US) 99654; Joseph F. Maestas, 300 Kalli Cir., Wasilla, AK (US) 99654

( * ) Notice: Subject to any disclaimer, the term of this patent is extended or adjusted under 35 U.S.C. 154(b) by 0 days.

(21) Appl. No.: 10/903,202

(22) Filed: Jul. 30, 2004

(51) Int. Cl.
*A63B 21/008* (2006.01)
*A63B 7/04* (2006.01)
*A63B 23/12* (2006.01)

(52) U.S. Cl. ..... 482/37; 482/49; 482/92; 482/112; 482/120; 273/451

(58) Field of Classification Search ..... 482/23, 482/34, 37, 44, 49, 72, 73, 112, 113, 120, 482/145, 148, 906; 273/451
See application file for complete search history.

(56) References Cited

U.S. PATENT DOCUMENTS 3,572,700 A * 3/1971 Mastropaolo ..... 482/2
4,772,013 A * 9/1988 Tarlow, Jr. ..... 482/73
5,060,938 A * 10/1991 Hawley, Jr. ..... 482/37
5,076,574 A * 12/1991 Johnson, Jr. ..... 482/37
5,316,535 A * 5/1994 Bradbury ..... 482/135
5,318,491 A 6/1994 Houston
5,380,258 A * 1/1995 Hawley, Jr. ..... 482/37
5,496,234 A * 3/1996 Sussich ..... 482/37
2005/0148437 A1* 7/2005 Ryan et al. ..... 482/37

FOREIGN PATENT DOCUMENTS

GB 2341806 A 3/2000
JP 03188879 A * 8/1991
SU 1600803 A * 10/1990

* cited by examiner

*Primary Examiner*—Stephen K. Cronin
*Assistant Examiner*—Victor K. Hwang
(74) *Attorney, Agent, or Firm*—Michael J. Tavella

(57) ABSTRACT

A portable, stable rope-pulling exercise machine. The machine has a stable support frame, a number of rope pulleys and rope guides mounted on the frame, an endless rope extending around the pulleys and guides to form a path which includes a horizontally extending rope pulling portion, and hydraulic braking assembly coupled to the pulley system for controlling the rate of movement of the rope based upon the strength of the user when said user is pulling the rope. The machine allows a user to pull a rope continuously as in a simulated tug-of-war. The short frame allows the device to be installed anywhere. A seat with a footrest allows a user to gain leverage when exercising with the rope.

18 Claims, 6 Drawing Sheets

HORIZONTAL ROPE PULLING APPARATUS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to rope pulling apparatus and particularly to horizontal rope pulling apparatus using endless ropes.

2. Description of the Prior Art

Pulling ropes have been a part of fitness gyms for many years. Rope pulling is an excellent exercise for the wrists, hands and upper body. Traditionally, these ropes have been long (20 foot) lengths of rope that were suspended from a gym ceiling. There are two problems with the traditional fixed rope as an exercise tool. First, there are few buildings used for gyms today that have high enough ceilings. Second, a 20-foot length of rope does not provide enough sustained effort to enable someone skilled in rope pulling exercise to receive a sufficient workout. Once a person has reached the top of the rope, he or she must descend before he or she can climb again.

To overcome these difficulties, endless rope exercise machines have been invented. These devices use a frame, an endless length of rope and a means of resistance to simulate actual rope pulling. Such machines enable a user to "climb" a rope for as long as the user's stamina permits. U.S. Pat. No. 5,076,574 discloses a portable rope pulling exercise apparatus that has a frame, a series of pulleys supporting a rope, and a hydraulic brake system to provide resistance for the rope.

In addition to vertical rope pulling machines, it is also desirable to have horizontal rope pulling machines that can simulate a tug-of-war. One example of such a machine is found in U.S. Pat. No. 5,318,491, which shows a machine that has a rope extending from a control box. The box has parts that adjust the tension of the rope and the pulling force. The user stands on a treadmill. As the user pulls on the rope, the user moves on the treadmill. Alternatively, the treadmill can be locked for static rope pulling. The problem with this machine is that it is bulky with the treadmill. Moreover, although this device can simulate a tug-of-war, such a simulation is not the best exercise that can be obtained using a pulled rope. Finally, the displacement of the rope is such that it is not guarded. Thus, it appears that when not in use, the rope is left lying on the treadmill, which is a tripping hazard. In addition, the rope is dispensed through two holes that are narrowly spaced apart. This can lead to discomfort when the rope is under tension, because the loop may close on the user's hands.

Another horizontal pulling machine is found in GB 2,341,806. FIG. 3 of that patent shows the device. Here, a user reclines in a chair. A footrest is also provided to enable better pulling force. The endless rope is shown running from the front to the back, over a series of pulleys. The rope passes down and under the machine, where it then returns to the front and up again to the user. The problem with this machine is that the user must keep the rope to one side of the user's body. Thus, the user can exercise only one side at a time. In addition, the rope is shown passing under the user's arm on its way to the back of the machine. This is uncomfortable and may cause irritation and chaffing during use.

BRIEF DESCRIPTION OF THE INVENTION

The instant invention overcomes all of these problems. It is a portable, stable, horizontal rope pulling exercise machine that has a stable support frame that extends into the room, allowing the unit to be placed close to a wall. It has a plurality of rope pulleys and rope guides mounted to a friction drive mechanism. This leaves the frame free of rotating components. An endless rope extends around the pulleys and guides to form a path which includes a horizontally extending rope portion, and an hydraulic braking assembly coupled to the pulley system for controlling the rate of movement of the rope based upon the weight of the user when said user is pulling the rope. The key to this device is the seat portion, attached to the horizontal frame. This allows the user to sit (or more precisely assume a bent legged position) while using the machine. The rope passes through a hole in the seat, which eliminates any tripping hazard from the rope. Because the user sits to use the machine, the rope does not pass under the user's arms. This makes the device more comfortable to use. Moreover, because the rope passes through the center of the seat portion, the user can use both arms equally to pull, thereby working both sides of the body simultaneously.

It is an object of this invention to provide a horizontal endless rope-pulling machine that has a frame that permits the machine to be installed in any location.

It is another object of this invention to provide a horizontal endless rope-pulling machine that provides a safe, protected pathway for the endless rope to travel.

It is a further object of this invention to provide a horizontal endless rope-pulling machine that utilizes an efficient braking system to provide frictional tension on the rope, It is yet a further object of this invention to provide a horizontal endless rope-pulling machine that provides alternate means of exercise using a horizontal endless pulling rope.

DETAILED DESCRIPTION OF THE INVENTION

Figure 1:
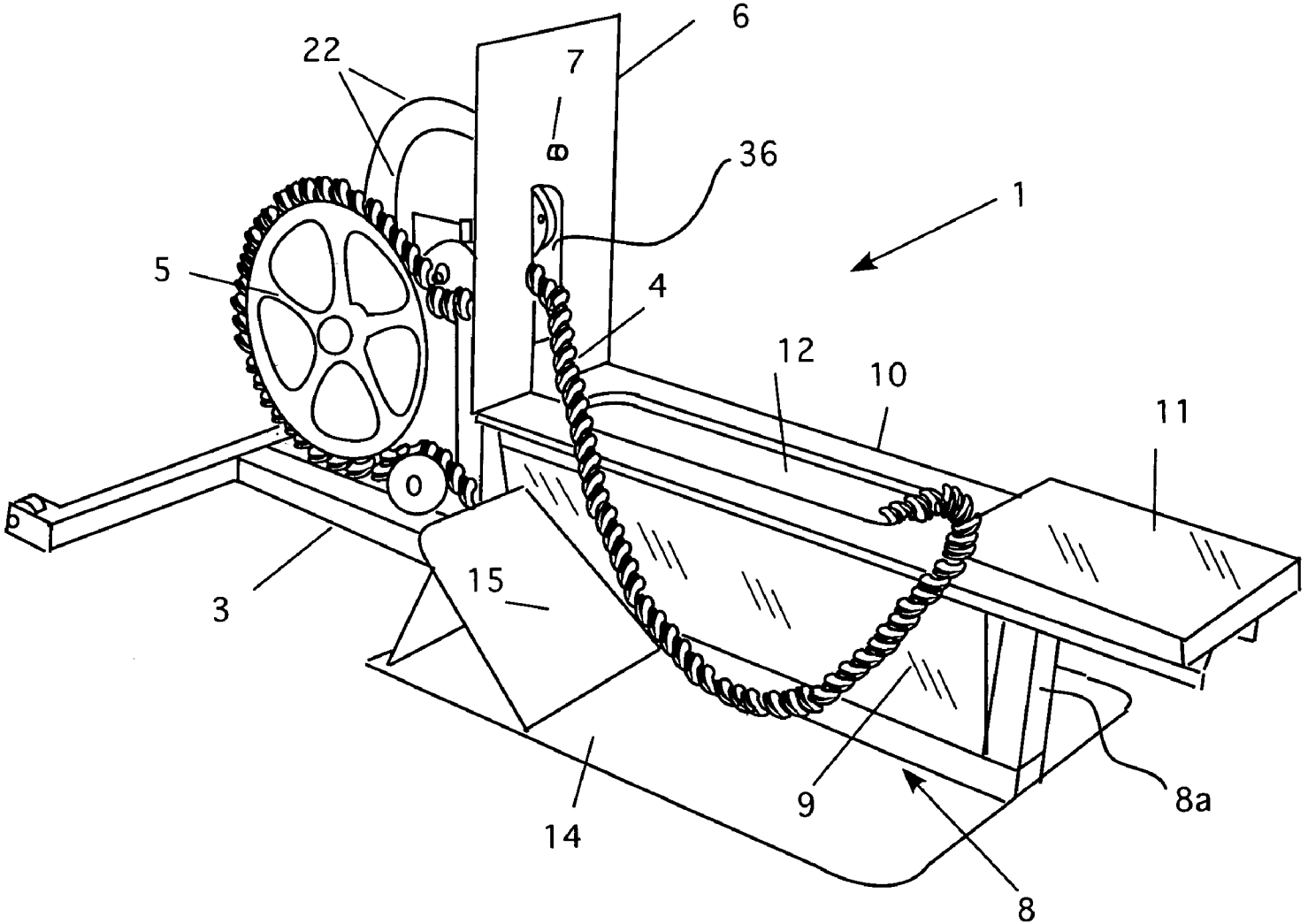
FIG. 1 is a left side perspective view of the invention.

Referring now to FIG. 1, the invention 1, is shown. The invention is a horizontal rope-pulling device. It is a machine that uses a hydraulic braking assembly (see FIGS. 2, 4, and 5) that is mounted on a frame 3 to support an endless rope 4 that is placed over a pulley 5. The rope 4 passes over the pulley 5 and then passes back through the vertical guard 6. This guard not only protects the user from the workings, it also provides a convenient place to mount the tension control knob 7 (discussed below).

A horizontal frame 8 extends back from the guard 6 as shown. It includes a top plate 10 and a seat 11. A support brace 8*a* elevates the seat 11 above the ground. Below the top plate 10 is a pair of plates 9 that frame a trough under the top plate 10. The top plate 10 has a slot 12 cut into it to allow the rope 4 to pass through as shown. The rope 4 runs down, under the top plate, through the trough, and through the vertical guard 6. It then runs up to the pulley 5, completing the loop. The plates 9 can be made of metal or plastic.

Figure 2:
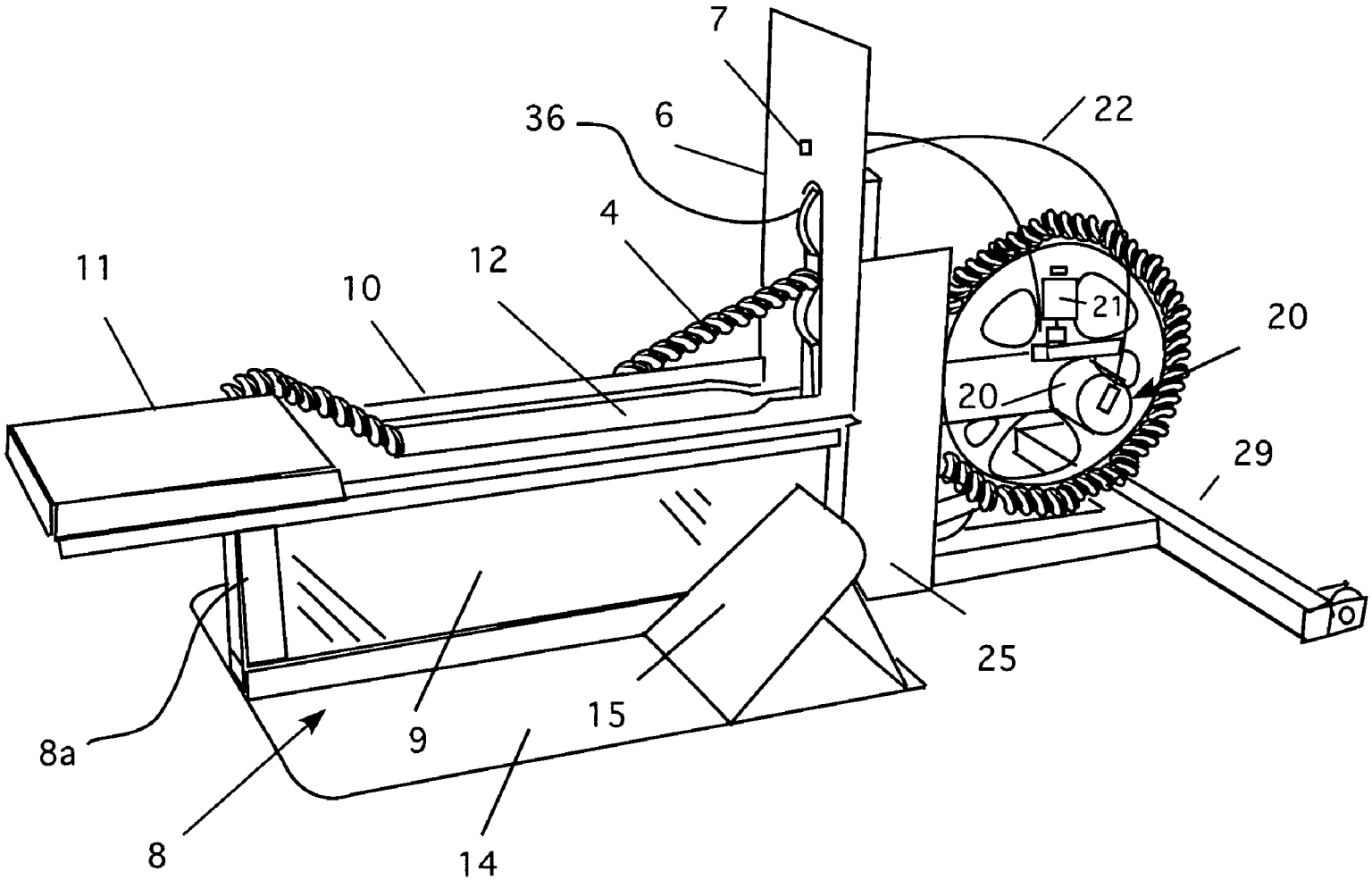
FIG. 2 is a right side perspective view of the invention.

FIG. 2 is a detail view of the pulley and braking system from the right side of the machine. Also shown in the figure is the right side guard 25. Note that the device has a base 14 that is part of the horizontal frame 8. This base 14 gives the machine stability, as well as providing a place for the user to place his or her feet. Footrests 15 are attached to base 14 on either side of the device as shown. The footrests allow a user to place the user's feet on the footrest while exercising. In this way, the user can lift up off the seat during a work out, providing better leverage when pulling the rope.

This figure also shows the braking system 20 from the right side of the machine. Here, the main cylinder 20, the reservoir 21, the hydraulic lines 22 and the control knob 7 are shown. The main cylinder is connected to the drive pulley 5 by a shaft. As the control is adjusted, the hydraulic system increases the amount of force needed to turn the main cylinder and the drive pulley. This increased force translates to increased pulling resistance experienced by the user. In this way, the amount of energy needed to pull the rope can be adjusted as desired by the user.

Figure 3:
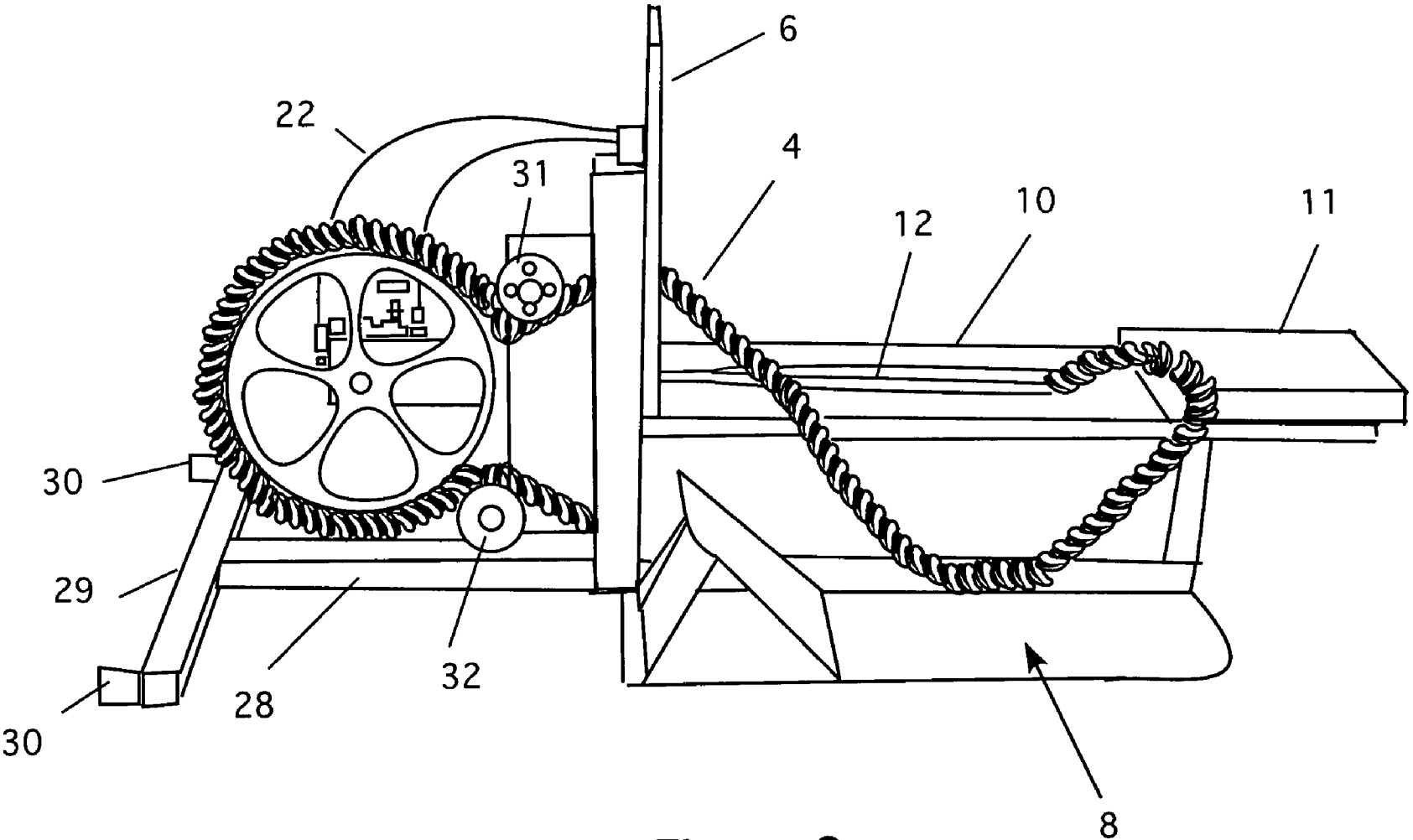
FIG. 3 is a left side elevation view of the invention.

FIG. 3 is a left side view of the device. Here, the front frame is shown. It has a center member 28, a cross member 29 and two wheel wells 30. Note that this figure shows the rope 4 passing under an upper guide pulley 31 and over the tension pulley 32. This figure also shows the rope exiting through the front of the horizontal support member.

Figure 4:
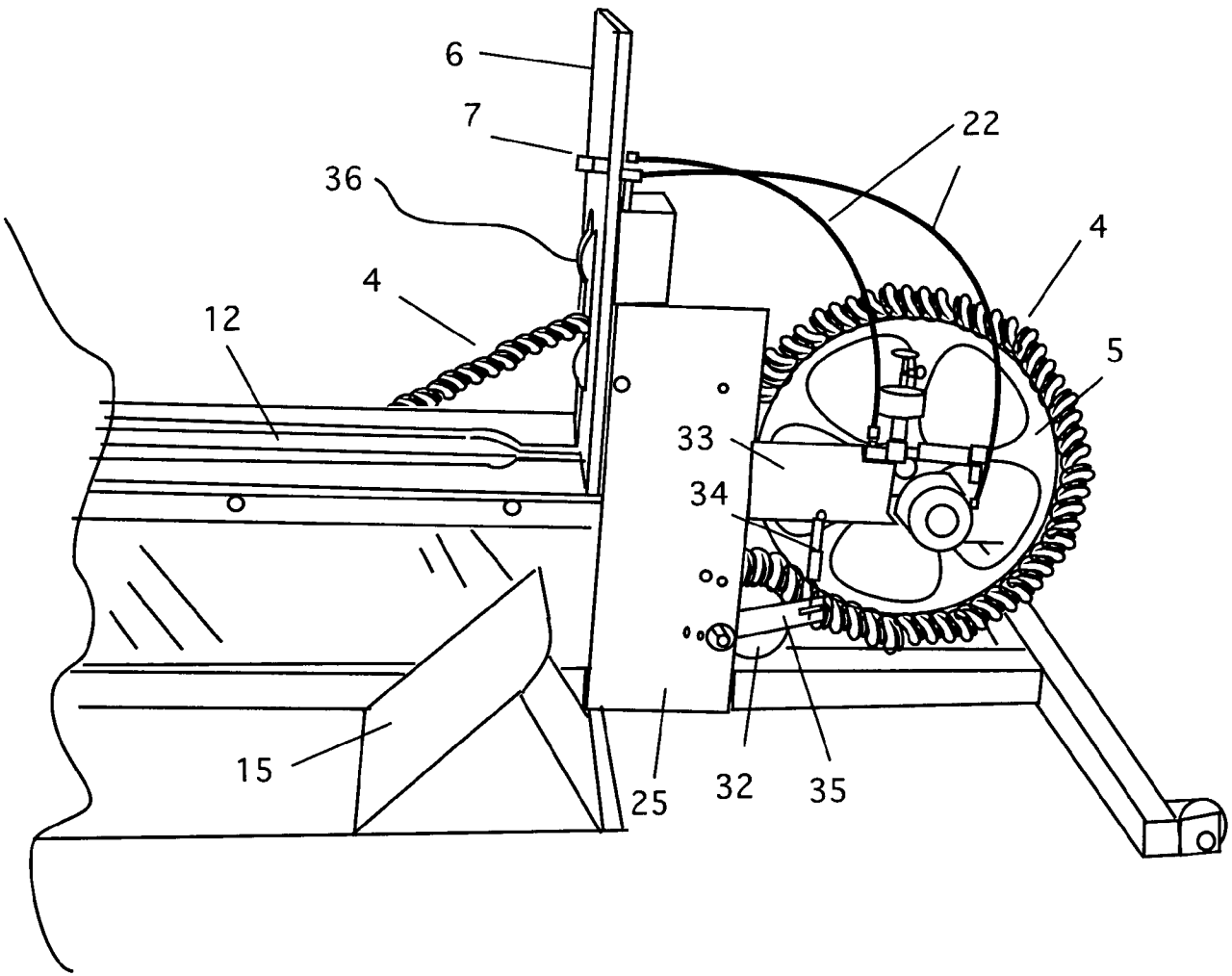
FIG. 4 is a right side detail view of the control system for the invention.

FIG. 4 shows details of the tensioning and braking systems. A support plate 33 is attached to the right side guard plate 25. The plate 33 supports the hydraulic equipment. A vertical member 34 attached to a side lever 35, which, in turn, is attached to the tension pulley 32. As the tension is adjusted, member 34 raises and lowers the lever 35, which increases or decreases the contact of the pulley on the rope 4. The tensioning system is designed to keep tension on the rope to ensure it remains in contact over the pulley 5.

Figure 5:
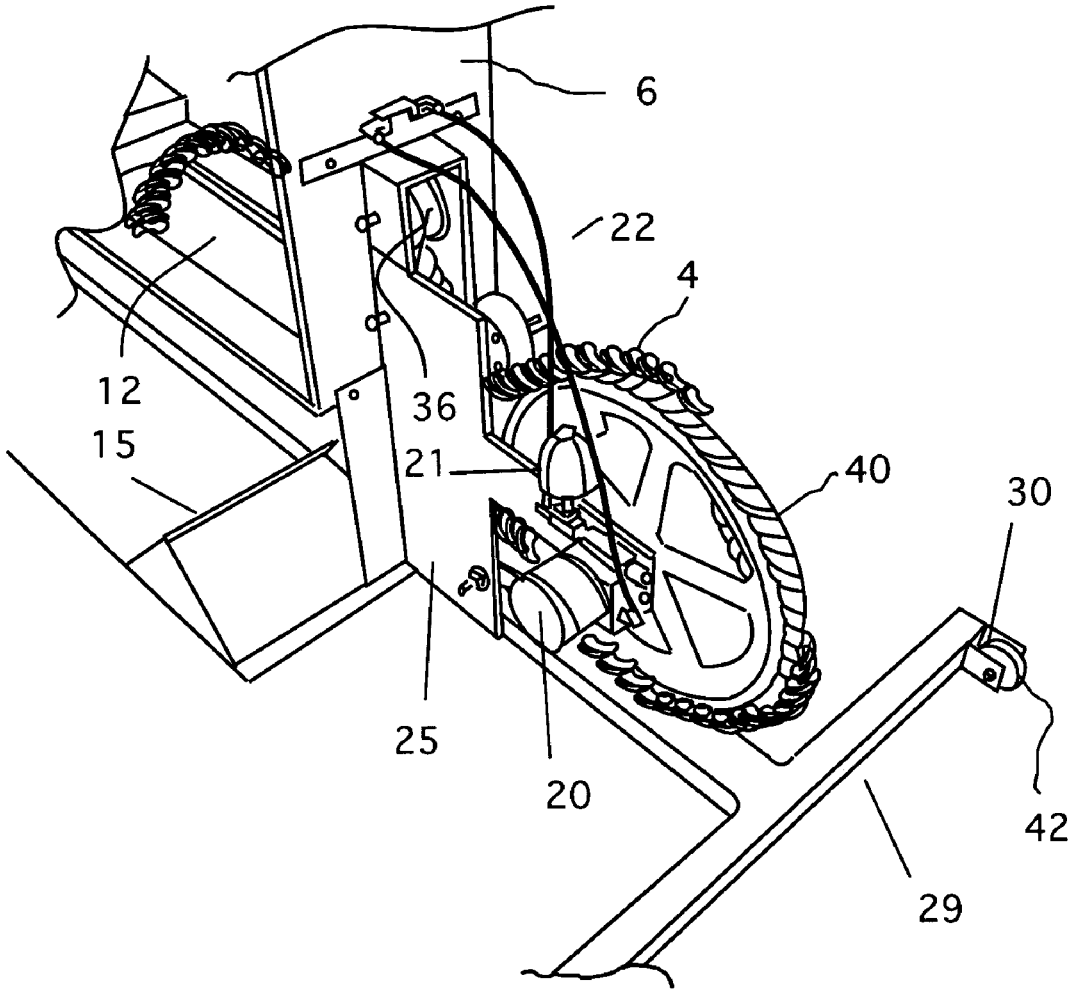
FIG. 5 is a right side perspective detail view of the front of the invention.

FIG. 5 shows additional details of the braking system. It also shows a through pulley 36, mounted in the vertical guard. This pulley guides the rope trough the vertical guard. A second pulley is mounted in the base of the vertical guard for the same purpose.

Note that FIG. 5 also shows details of the main pulley 5. In this view, the rope 4 is shown pulled away from the pulley 5. This shows the indentations 40 formed in the outer circumference of the pulley 5. These indentations are shaped like the rope and are designed to ensure a tight fit of the rope onto the pulley when it is under tension, to prevent the rope from slipping.

Figure 6:
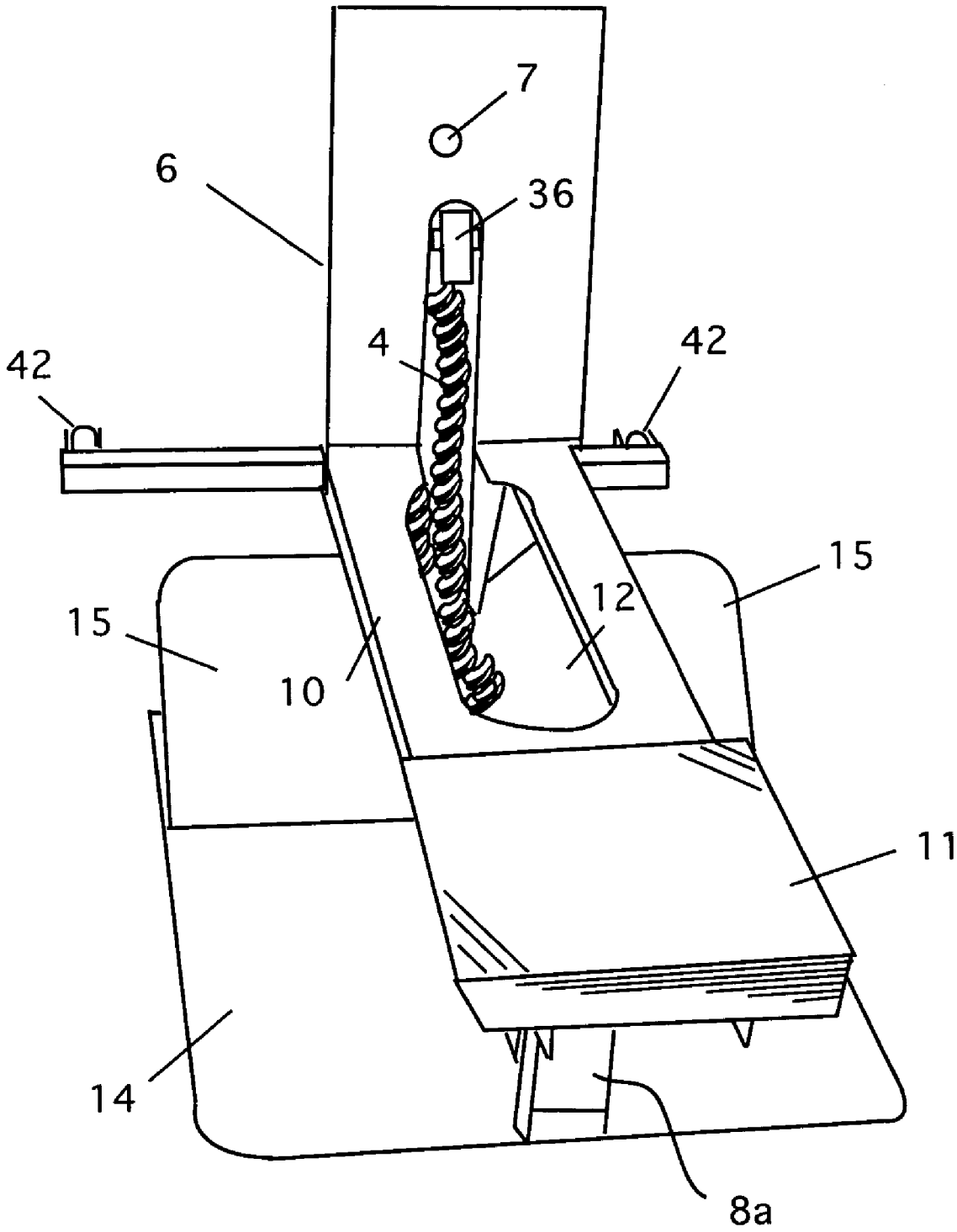
FIG. 6 is a forward-looking perspective view of the frame and seat

Finally, FIG. 6 shows a rear view of the device. Here, the pulley 36 is shown in the vertical guard. The slot 12 is also shown in the top plate 10. Finally, the wheels 42 are shown in the wheel wells 30 on the front portion of the frame.

The use of the device is simple. A user first sets the control valve 7 to the proper setting, based on the user's strength. Then, the user sits on the bench with the rope passing between the user's legs and down through the trough. The user can then pull the rope backward. To do this the user must overcome the resistance of the brake. The ideal setting is where the user pulls him or her up slightly off the seat, and remains suspended while pulling the rope.

To gain even more advantage, the user can place the user's feet on the footrest to use the user's legs to maintain the desired position. The user then pulls the rope as in a tug-of-war. The user can continue in this manner for as long as desired.

Unlike other designs, the rope does not pass under the user's arms, or by the user's body. This makes for smoother, more even pulling and prevents injuries and chafing from the rope when it passes by the user's body.

There is another function available on this device that is not available on other devices. Because of the position of pulley 36 (see, FIGS. 1 and 6), it is possible to pull upward on the rope. For this use, the user straddles the top plate 10 and stands. The user then grasps the rope and pulls upward against the pulley 36. This allows the user to perform a rope pulling curl type exercise.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. An endless rope exercise machine comprising:

a) a frame having a vertical portion and a horizontal portion and horizontal portion, said vertical portion having a top and a bottom, said horizontal portion having a front and a back, said bottom of said vertical portion having an opening therein, said horizontal portion having an elongate opening formed therein, said frame being assembled such that the bottom of said vertical portion is aligned with the front of said horizontal portion;

b) an endless rope, said endless rope being positioned about said frame;

c) a braking mechanism attached to said frame; and d) a drive pulley attached to said braking mechanism; whereby said endless rope passes over said drive pulley, extends rearward in a substantially horizontal direction through said vertical portion, extends rearward from said vertical portion in the substantially horizontal direction, extends downward through the opening in said horizontal portion, forward through said vertical portion, under said drive pulley and upward over said drive pulley.

2. The exercise device of claim 1 wherein the braking mechanism comprises a hydraulic pump, having a pumping force, attached to said drive pulley.

3. The exercise device of claim 2 further comprising a means for controlling the pumping force of said hydraulic pump.

4. The exercise device of claim 3 wherein the means for controlling the force applied to said drive pulley comprises a valve, in hydraulic communication with said pump.

5. The exercise device of claim 4 wherein the braking mechanism further comprises a reservoir in hydraulic communication with said pump.

6. The exercise device of claim 3 wherein the means for controlling the force applied to said drive pulley includes a control knob.

7. The exercise device of claim 1 further comprising:

a) a tensioning pulley, slidably attached to said frame and being in contact with said rope, whereby said rope is positioned between said tensioning pulley and said drive pulley; and b) a means for adjusting the position of said tensioning pulley in said frame such that he rope remains in tight contact with the drive pulley.

8. The exercise device of claim 1 further comprising a seat, attached to horizontal portion.

9. The exercise device of claim 1 wherein horizontal portion further comprises a footrest.

10. An endless rope exercise machine comprising:

a) a frame having a vertical portion and a horizontal portion, said vertical portion having a top and a bottom, said horizontal portion having a front and a back, said bottom of said vertical portion having an opening therein, said horizontal portion having a first panel and a second panel, said first and second panel having a trough formed therebetween, said horizontal portion also having a top plate having a slot formed therein;

b) an endless rope, said endless rope being positioned about said frame;

c) a braking mechanism attached to said frame; and d) a drive pulley, attached to said braking mechanism;

e) whereby said endless rope wraps around said drive pulley, extends downward under said drive pulley, through said vertical portion, upward through said trough in said horizontal portion, upward through said slot in said top plate, forward through said vertical portion and over said drive pulley.

11. The exercise device of claim 10 wherein the braking mechanism comprises a hydraulic pump, having a pumping force, attached to said drive pulley.

12. The exercise device of claim 11 further comprising a means for controlling the pumping force of said hydraulic pump.

13. The exercise device of claim 12 wherein the means for controlling the force applied to said drive pulley comprises a valve, in hydraulic communication with said pump.

14. The exercise device of claim 12 wherein the braking mechanism further comprises a reservoir in hydraulic communication with said pump.

15. The exercise device of claim 12 wherein the means for controlling the force applied to said drive pulley includes a control knob.

16. The exercise device of claim 10 further comprising:

a) a tensioning pulley, slidably attached to said frame and being in contact with said rope, whereby said rope is positioned between said tensioning pulley and said drive pulley; and b) a means for adjusting the position of said tensioning pulley in said frame such that he rope remains in tight contact with the drive pulley.

17. The exercise device of claim 10 further comprising a seat, attached to horizontal portion.

18. The exercise device of claim 10 wherein horizontal portion further comprises a footrest.

* * * * *